US005823594A

United States Patent [19]

Hayes et al.

[11] Patent Number: 5,823,594

[45] Date of Patent: Oct. 20, 1998

[54] FIREWOOD TOTE

[75] Inventors: Matthew I. Hayes, San Diego; Jeffrey A. Hayes; William R. Lilliott, III, both of Encinitas, all of Calif.

[73] Assignees: Nyda Jopling Sterett, Rancho Santa Fe; Peter J. Kauffman, Del Mar; Robert Haggstrom, Malibu, all of Calif.; part interest to each

[21] Appl. No.: 882,894

[22] Filed: Jun. 26, 1997

[51] Int. Cl.[6] ..... B65D 63/18

[52] U.S. Cl. ..... 294/142; 224/250; 294/152

[58] Field of Search ..... 294/74, 138, 140–142, 294/149–157; 224/250, 257, 575–578, 600, 602

[56] References Cited

U.S. PATENT DOCUMENTS

| | | | |
|---|---|---|---|
| 340,303 | 4/1886 | Fransson . | |
| 423,380 | 3/1890 | Fry | 294/152 |
| 466,670 | 1/1892 | Fler . | |
| 1,199,330 | 9/1916 | Adams | 294/152 X |
| 1,222,973 | 4/1917 | Morter . | |
| 1,861,431 | 5/1932 | Crawford | 294/152 X |
| 1,904,729 | 4/1933 | Hancock et al. . | |
| 1,938,478 | 3/1933 | Bailer . | |
| 2,485,864 | 10/1949 | Cohen et al. . | |
| 2,508,795 | 5/1950 | Nielsen | 294/152 |
| 4,431,226 | 2/1984 | Weilert | 294/152 X |
| 4,480,774 | 11/1984 | Smith et al. . | |
| 4,591,201 | 5/1986 | Antonelli | 294/137 |
| 4,950,014 | 8/1990 | Smith | 294/152 |

*Primary Examiner*—Johnny D. Cherry
*Attorney, Agent, or Firm*—Henri J. A. Charmasson; John D. Buchaca

[57] ABSTRACT

A tote-caddy for carrying a load of firewood logs or similar loose set of objects comprises a canvas web having at one end a strap for suspending the web from one of its edges to the shoulder of a user, a handle at an opposite edge of the web, and at least one additional handle at an intermediary location along the web; so that a variety of loads and object shapes can be adjustably carried within a loop formed in the web between the strap-supported edge of the web and one of the handles.

14 Claims, 1 Drawing Sheet

FIREWOOD TOTE

FIELD OF THE INVENTION

This invention relates to a carrier for loose articles such as firewood and the like, and more specifically to tote-caddies to be supported by a human.

BACKGROUND OF THE INVENTION

A variety of canvas carriers for firewood logs and similar objects have been devised in the past, as most notably disclosed in U.S. Pat. No. 340,303 to Franson, No. 2,485,864 to Cohen et al., No. 4,591,201 to Antonelli, and No. 4,950,014 to Smith. However, in all the devices of the prior art, the entire load is supported by the hand or hands of the user. Moreover, there is no practical way to adjust the size of the web to accommodate variety in the load and the shape of the carried goods.

SUMMARY OF THE INVENTION

The principal and secondary objects of this invention are to provide a firewood log carrier in which the size of the loop or pocket holding the load can be conveniently adjusted, and where a portion of the weight bears upon the shoulder of the user.

Those and other valuable objects are achieved by a tote comprising an oblong web in which one of the extremities is provided with a strap shaped and dimensioned to pass over the shoulder of the wearer, and wherein a plurality of handles are provided along the web and at opposite ends, each to work in cooperation with the shoulder strap to support the load.

DESCRIPTION OF THE PREFERRED EMBODIMENT OF THE INVENTION

Figure 1:
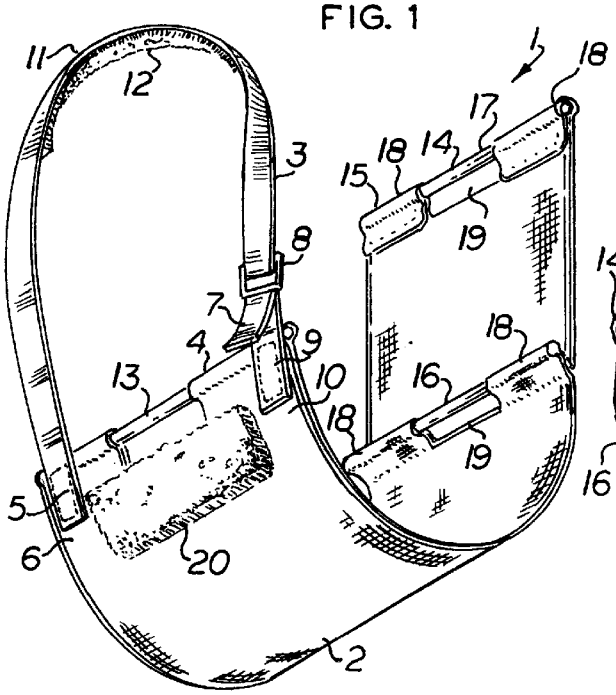
FIG. 1 is a perspective view of a tote-caddy according to the invention.

Referring now to the drawing, in FIG. 1 there is shown a tote-caddy 1 which comprises an oblong web 2 made from flexible material, preferably a strong type of canvas. The web defines a rectangle of approximately 40 by 100 centimeters (15.8 by 40 inches). An elongated strap 3 is secured at both ends to a first short edge 4 of the web 2.

More specifically, a first end 5 of the strap is permanently stitched to the upper left corner 6 of the web 2. The opposite end 7 of the strap passes through an adjusting buckle 8 that is itself attached to a small strip 9 of material permanently stitched into the upper right corner 10 of the web opposite the upper left corner and across the upper edge 4. Accordingly, the length of the strap 3 can be conveniently adjusted to pass over the shoulder of a wearer, and to position the upper edge 4 near his or her hips. For comfort, a median section 11 of the strap that comes in contact with the shoulder is covered with padded material 12 such as a section of fleece. A handle 13 is also provided along the center part of the short edge 4 of the web. This handle may be omitted if the tote-caddy is intended to be supported only by the strap 3. A similar handle 14 is also provided in the median part of the opposite short edge 15 of the web.

An additional handle 16 is also provided along the web in the location spaced apart from both short edges 4 and 15 of the web. Each handle comprises a batten 17 having a length substantially equal to the width of the web. Opposite ends of the batten are inserted into loops 18 formed in the material of the web. A section of the web 19 is cut away in an area proximate to the center of the batten to provide a convenient space for the wearer's inserting his hand to grasp the batten.

For the comfort of the user, a section of padding material 20 such as fleece is affixed in a marginal section along the upper edge 4 of the web that comes in contact with the hip of the wearer.

As illustrated in FIGS. 2–5, the tote-caddy 1 can be used in a variety of manners.

Figure 2:
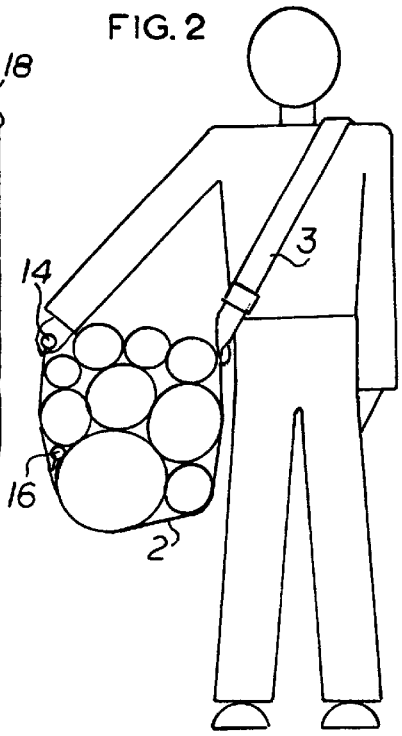
FIG. 2 illustrates a first mode of use.

In a first mode, the user adjusts the strap over his or her left shoulder to bring the upper edge 4 of the web to the level and against the right waist or hip area while grasping the most distal handle 14 at the opposite end of the web. This mode of use is particularly indicated for heavy and bulky loads as shown in FIG. 2.

Figure 3:
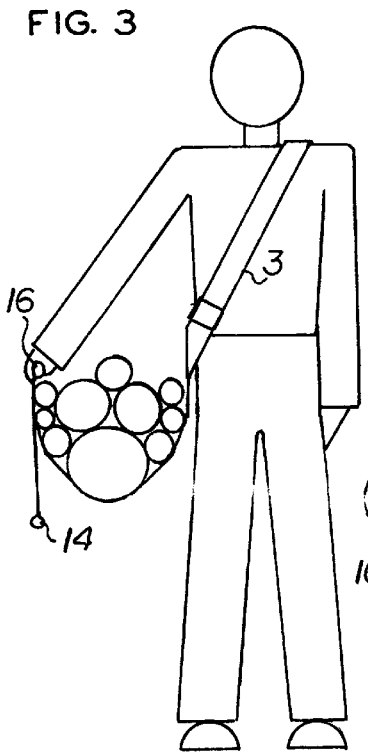
FIG. 3 illustrates a second mode of use.

A less bulky load may be carried as shown in FIG. 3 by the user grasping the intermediary handle 16 in order to form a smaller carrying pocket.

Figure 4:
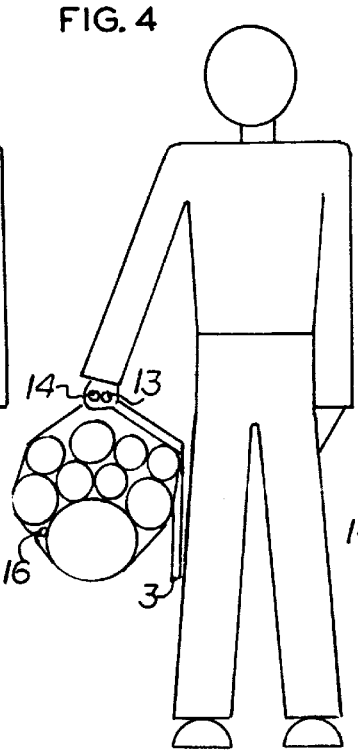
FIG. 4 illustrates a third mode of use.

FIG. 4 illustrates how the tote-caddy can be used in a conventional way without the strap to carry bulky loads by grasping handles 13 and 14 at opposite ends of the web.

Figure 5:
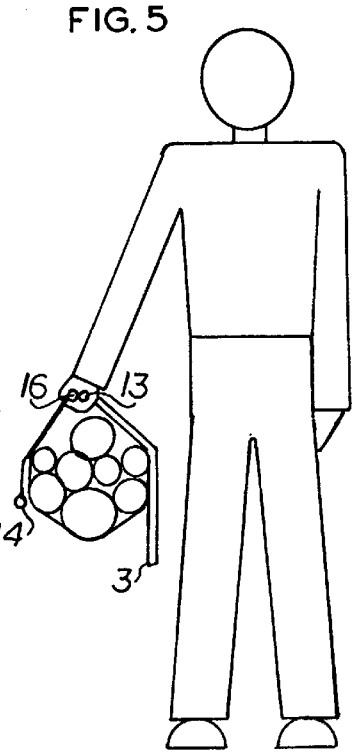
FIG. 5 illustrates a fourth mode of use.

Finally, smaller loads can be more conveniently carried as shown in FIG. 5 where the central handle 16 is grasped along with one of the lateral handles 13 or 14.

While the preferred embodiment of the invention has been described, modifications can be made and other embodiments may be devised without departing from the spirit of the invention and the scope of the appended claims.

What is claimed is:

1. The caddy for carrying firewood logs and other loose similar articles which comprises:

an oblong web made of flexible and pliable material, said web having first and second opposite short edges;

a strap having two opposite ends secured to said web proximate said first edge, said strap being shaped and dimensioned to pass over a wearer's shoulder and to position said first edge about said wearer's hips;

a first handle associated with said web and located about said second edge; and at least one additional handle associated with said web and located between and spaced apart from said first and second edges;

whereby the wearer can carry articles in a loop of said web formed between said first edge and one of said handles.

2. The caddy of claim 1, wherein said web is made of canvas.

3. The caddy of claim 1, which further comprises padding material affixed to said web in a marginal area along said first edge.

4. The caddy of claim 3, wherein said padding material comprises a section of fleece.

5. The caddy of claim 1, which further comprises means for releasably and adjustably securing one end of said strap to said web.

6. The caddy of claim 1, wherein each of said handles comprises a batten having opposite extremities nested into loops formed in said web.

7. A caddy for carrying a loose load of fire logs and other similar goods which comprises:

an oblong web made of flexible and pliable material, said web having first and second opposite short edges;

holding means associated with said web and located about said first edge;

a first handle associated with said web and located about said second edge; and at least one additional handle associated with said web and located between and spaced apart from said first and second edges;

whereby a user can carry goods in a loop of said web between said holding means and one of said handles, or between two of said handles.

8. The caddy of claim 7, wherein said holding means comprises a supplemental handle.

9. The caddy of claim 8, wherein said holding means further comprise a strap having two opposite ends secured to said web proximate said first edge, said strap being shaped and dimensioned to pass over said user's shoulder and to position said first edge about said user's waist.

10. The caddy of claim 7, wherein said web is made of canvas.

11. The caddy of claim 7, which further comprises padding material affixed to said web in a marginal area along said first edge.

12. The caddy of claim 11, wherein said padding material comprises a section of fleece.

13. The caddy of claim 7, which further comprises means for releasably and adjustably securing one end of said strap to said web.

14. The caddy of claim 7, wherein each of said handles comprises a batten having opposite extremities nested into loops formed in said web.

* * * * *